United States Patent [19]

Terry et al.

[11] Patent Number: 4,990,370

[45] Date of Patent: Feb. 5, 1991

[54] ON-LINE SURFACE AND EDGE COATING OF FIBER GLASS DUCT LINER

[75] Inventors: James R. Terry, Cleburne, Tex.; Kent R. Matthews, Littleton, Colo.; Ricky W. Totsch, Joshua; Donny L. Timms, Cleburne, both of Tex.

[73] Assignee: Manville Corporation, Denver, Colo.

[21] Appl. No.: 503,082

[22] Filed: Apr. 2, 1990

Related U.S. Application Data

[63] Continuation of Ser. No. 349,199, May 9, 1989, abandoned.

[51] Int. Cl.[5] ..... B05D 1/00; B05C 3/00

[52] U.S. Cl. ..... 427/209; 427/284; 427/359; 427/345; 118/410; 118/413; 118/414

[58] Field of Search ..... 427/209, 284, 359, 345; 118/410, 413, 414

[56] References Cited

U.S. PATENT DOCUMENTS

| | | | |
|---|---|---|---|
| 3,218,187 | 11/1965 | Wade, Jr. | 427/284 |
| 4,226,662 | 10/1980 | McCort | 427/284 X |
| 4,371,568 | 2/1983 | Von Tell | 427/345 X |

*Primary Examiner*—Shrive Beck
*Assistant Examiner*—Alain Bashore
*Attorney, Agent, or Firm*—John D. Lister; Cornelius P. Quinn

[57] ABSTRACT

Apparatus and a method is shown for continuously, in an on-line production, applying a layer of coating material to the horizontal upper surface of a fiber glass blanket and the opposed vertical edge surfaces in a generally even layer and curing the applied material to form surface and edge coated fiber glass duct liner material.

9 Claims, 5 Drawing Sheets

ON-LINE SURFACE AND EDGE COATING OF FIBER GLASS DUCT LINER

This is a continuation of application Ser. No. 07/349,199, filed May 9, 1989.

BACKGROUND OF THE INVENTION

1. Field of the Invention

This invention generally relates to a method and apparatus for surface coating a relatively dense fiber glass blanket to form a duct liner product and the so-formed duct liner and more specifically, to an on-line method and fabrication apparatus for applying a surface coating to one facing surface and the edge surfaces of a fiber glass blanket to provide a fiber glass duct liner product wherein all surfaces exposed to air traveling through the duct are coated with an applicable coating.

2. Description of the Prior Art

It is well known and standard practice to use a relatively dense layer of flexible fiber glass as an internal liner for sheet metal ductwork in heating, ventilating and air conditioning applications. Such liners function both as an insulation to conserve the temperature of the air within the duct and to prevent condensation on the duct exterior surfaces, and at the same time, provide efficient sound absorption to control airborne noises. In that the fiber glass liner is on the inside of the duct and therefore adjacent the high velocity air, it is a requirement of certain federal, state, local and trade association regulations that the liner meet certain standards for use in such environment.

One of the typical standards the liner must exhibit is a resistance to erosion by the air flowing through the duct. Such standard requires that duct liners shall not break away, flake off or show evidence of delamination or continued erosion when air is passed through typical sections at a velocity of 2½ times rated velocity but not less than 5000 ft/min. Therefore, to accommodate such standard it is typical for fiber glass duct liner manufacturers to coat the face of the fiber glass blanket which will be exposed to the air with a coating that prevents erosion of the glass fibers from such surface under the above established conditions. Such coatings can be a rubberized or plastic type material that is applied onto such surface of the fiber glass and when cured forms a tough skin on such surface. Alternatively, or in conjunction therewith, a fabric layer such as a Chicopee material can be adhered to such surface of the fiber glass.

Also, as is typical in the industry, the manufacturers of fiber glass duct liner provide the heating, ventilating and air conditioning contractor, installing the ducts, with rolls of fiber glass duct liner in lengths of approximately 100 feet and in standard widths varying from between 2 to 5 feet. The contractor in turn, often times in an automatic coil line, adheres the fiber glass duct liner to a surface of the sheet metal with the coated side of the duct liner being exposed, thereafter trimming the sheet metal and duct liner combination to standard lengths which are thereafter formed into length having an "L" shaped configuration. Two such L's placed in opposed relationship and joined along their mating seams thereby provide a length of duct with the fiber glass liner providing the inside surface. As will be more clearly explained hereinafter, each end of a duct, as formed above, may have an exposed edge surface of the fiber glass liner.

Heretofore it has not been the practice of fiber glass duct liner manufacturers to coat that portion of the liner which forms this edge surface; however, as the thickness of such edge is not always consistent, because of the variations in the thickness of the fiber glass liner, a joint of two such ducts may expose a portion of the uncoated edge surface to the air flow and provide a potential area of erosion. It has thus been the practice of the contractor, to comply with the appropriate standards, to coat such exposed edges of the fiber glass. Normally this is done while the L-shaped lengths are serially stacked in a manner to expose the edges. This coating typically has been the same adhesive that was applied to adhere the fiber glass to the sheet metal and can be done manually, as with a spray gun, brush, or roller, while the L-shaped lengths are in their stacked condition. However, it is evident that this requires further labor and handling by the contractor and can result in a rather messy, unattractive and potentially hazardous environment where the adhesive is indiscriminately sprayed or applied. Further, such adhesive coating may not, in fact, satisfy erosion standards.

SUMMARY OF THE INVENTION

The present invention provides an on-line method and apparatus for continuously coating the exposed main surface of fiber glass duct liner with a surface coating material that prevents erosion and, in the same on-line process, coating the edge surfaces of the fiber glass duct liner with the same material so that all surfaces of the duct liner that are exposed, or can potentially be exposed, to the air flow when formed into the air duct are coated by the material thereby eliminating the previous requirements of the contractor to manually coat the edge surfaces upon fabrication of the ducts, and the duct liner formed by such on-line method.

DETAILED DESCRIPTION OF THE INVENTION

Figure 1:
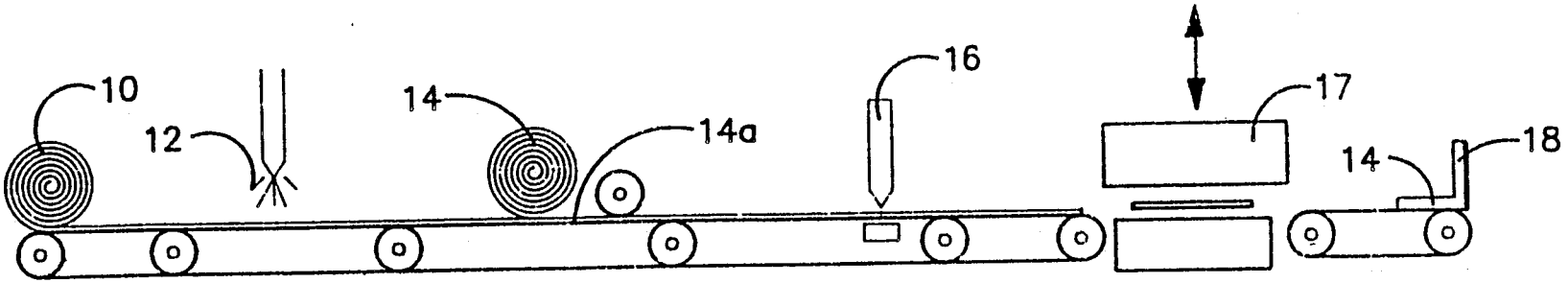
Fig. 1 PRIOR ART
FIG. 1 is a schematic view of an automatic coil line to illustrate the contractor's typical method of forming ducts with an interior fiber glass liner.

Referring to FIG. 1 an automatic coil line is shown to illustrate the application of the fiber glass duct liner material to sheet metal to form a lined air-transporting duct. This procedure is typically done by a heating, ventilation and air conditioning contractor who is obligated to provide duct that meets the standard criteria for, among other standards, the erosion of the duct liner. Thus, as is seen in FIG. 1, a roll of sheet metal material 10 is unrolled and adhesive 12 is applied to one surface. Thereafter, a roll of fiber glass duct liner 14, as supplied from the fiber glass duct liner manufacturer, is unrolled and adhesively and mechanically (i.e. through metal tie-downs, not shown) attached to the sheet metal surface. The fiber glass duct liner 14, as provided by the manufacturer, is typically coated on the upper face 14a with a coating that is capable of meeting the erosion standards of various governmental and licensing agencies. After the fiber glass duct and liner is adhered to the sheet metal, the metal is severed as at 16 into standard lengths which are then placed in a brake 17 wherein the flat metal piece, as covered by the liner material, is formed into a right angle L-shaped length 18 having the fiber glass duct liner 14 on the interior surfaces. The width of the sheet metal is a standard width which provides a standard length for a duct section. It is understood that the fiber glass duct liner 14 is also supplied in a standard width commensurate with the sheet metal so that the standard length of duct can be fabricated.

Figure 2:
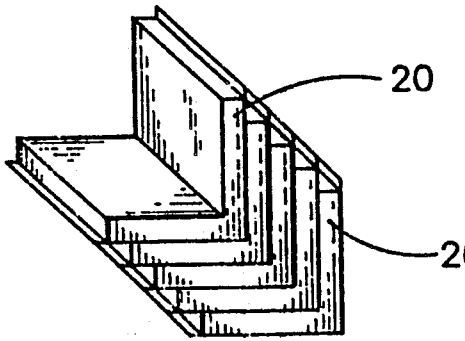
Fig. 2 PRIOR ART
FIG. 2 is an isometric view of liner-coated sheet metal formed into L-shaped lengths and stacked prior to being joined to form a lined duct.

Referring now to FIG. 2, it is seen that a plurality of such L-shaped lengths 18 are stacked together in a typical manner for storage prior to making the completed duct. In such condition the edge surfaces 20 of the fiber glass liner 14 are exposed and it is typical that the contractor apply coating to the duct liner edge surfaces 20 when in such stacked condition by manually spraying or otherwise applying, as by a roller or brush, the adhesive material or other edge coating material so that all surfaces of the fiber glass that potentially are or will be exposed to the air flow are prevented from erosion.

Figure 3:
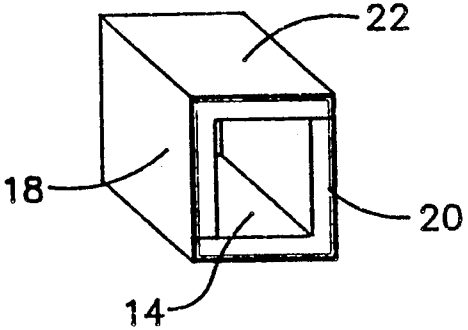
Fig. 3 PRIOR ART
FIG. 3 is an isometric view of a duct formed of the lined L-shaped lengths of FIG. 2 and showing the exposed edge surface of the fiber glass liner.

FIG. 3 shows a completed section of duct 22 formed by joining two L-shaped lengths 18 together with the fiber glass liner forming the interior surface. As therein seen the fiber glass liner 14 has an edge surface 20 that will meet with either an upstream or downstream adjacent duct section that, depending on the match of the thickness of the edge surfaces in each adjacent section, may cause certain edge surface portion to be exposed to the air flow within the duct.

Figure 4:
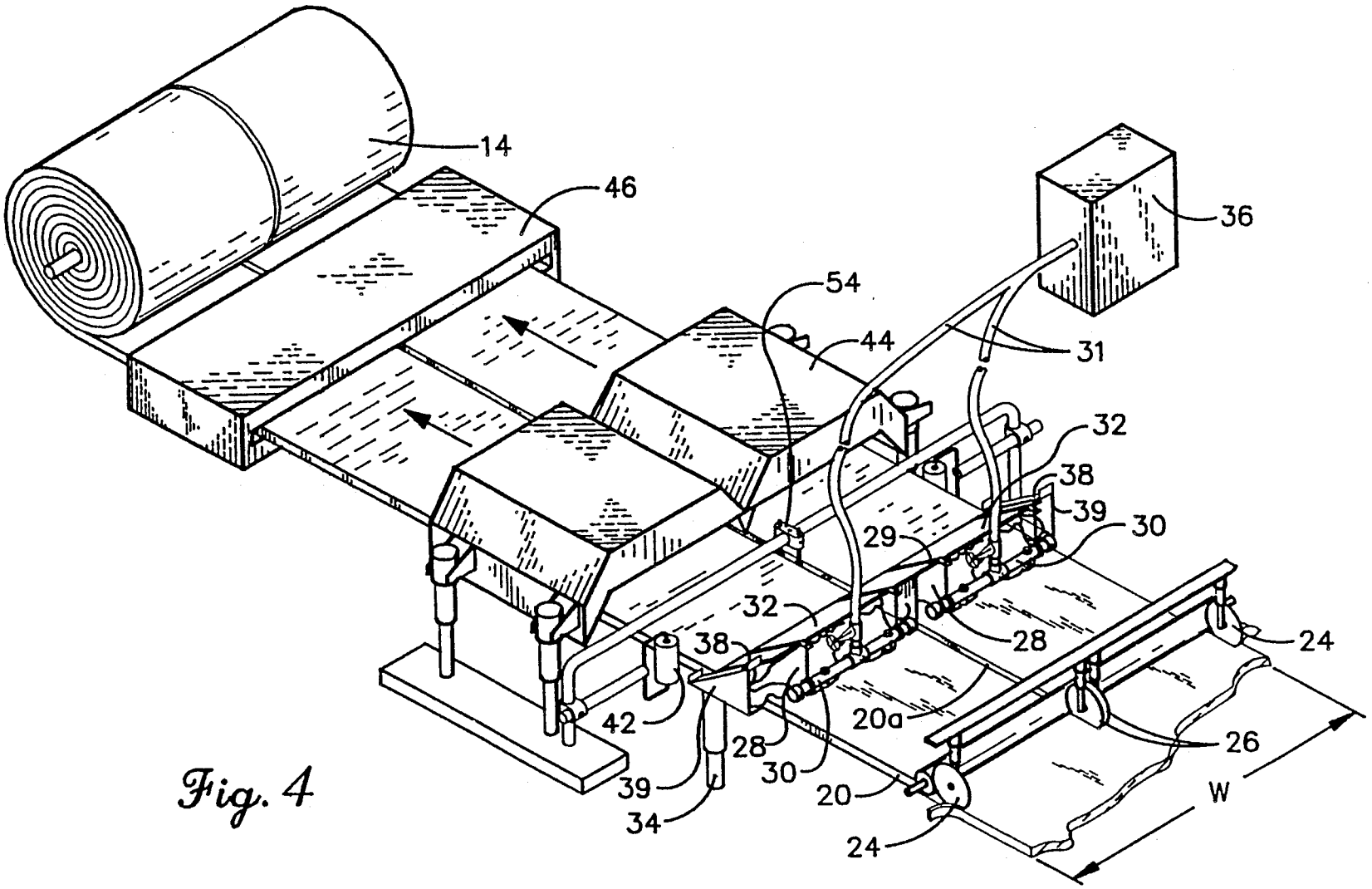
FIG. 4 is an isometric schematic view of the on-line method and apparatus of the present invention for coating a main surface and the edge surface of the fiber glass duct liner according to the present invention.

Reference is now made to FIG. 4 wherein the method and apparatus of the present invention for continuous on-line coating of one surface the fiber glass is completed along with coating the previously uncoated and exposed edge surfaces 20 of the fiber glass duct liner 14. It is to be understood that the fiber glass duct liner manufacturer has, upstream from FIG. 4, a supply of resin coated cured fiber glass material compressed to the appropriate density and formed into a blanket that is traveling in the direction of the arrows shown in FIG. 4. This blanket of fiber glass material 14 is initially trimmed with trimming discs 24 along the opposite marginal edges of the fiber glass blanket to trim the blanket to a standard width W. Such width W is typically of a standard width commensurate with the width of the sheet metal 10 forming the duct. However, the width W may also be a multiple of such standard width so that interior trimming discs 26 are utilized to separate the width W into multiple separate standard widths. Such multiple widths are shown in the present invention for purposes of illustrating that the interior edge surfaces 20*a* of such multiple widths are also concomitantly coated along with the opposed marginal edge surface 20.

Thus, still referring to FIG. 4 it is seen that subsequent to trimming the fiber glass blanket into the standard widths, the blanket continues to a coating operation wherein an appropriate coating material 28 is deposited on the upper surface of both separate portions of the blanket. In this instance the material 28 is deposited through a distributing header 30 suspended, as by standards 29, from an application blade 32 mounted just downstream from the header 30 through an adjustable mounting mechanism 34 that can elevate the application blade 32 to the desired position adjacent the blanket upper surface.

It is to be noted that the application blade 32 can be either two separate blades each extending from edge to edge of the respective portion of the blanket, or one single blade extending completely across the width W. In either case, the blade 32 is seen to slope downwardly in the direction of travel of the blanket. The coating material 28 is provided from a reservoir 36 under pressure to the respective distributing headers 30 as through supply lines 31 and is supplied in a quantity sufficient to form a puddle of excess material between the distributing header 30 and the application blade 32 on each respective portion of the blanket so that the application blade 32, when in the proper position, causes an even distribution and coating of the material 28 over the exposed upper surface of the blanket and, in addition, directs a portion of the material to flow over the opposed edge surfaces 20.

A dam member 38 is slidably mounted on the blade 32, in a manner to be described later, adjacent each trimmed outer or marginal edge surfaces 20 of the blanket. Another dam member 38*a* is likewise mounted on the blade 32 adjacent, and between, each interior edge surface 20*a* (if one continuous blade is used dam member 38*a*, of a structure to be described is used; however if two separate blades 32 are used, two previous dam members 38 could be used on each blade adjacent both the interior and exterior edge surfaces). Each dam member 38 and 38*a* is positioned in line with the application blade 32, with dam member 38 defining an outer wall 39 that confines the coating material 28 which has been directed to flow over the edges by the application blade 32, and both dam members 38 and 38*a* further define a blade-like member 40 , 40*a* respectively just adjacent the edge surface 20 and 20*a* that is angled in a manner to apply a layer of the material 28 to the edge surfaces 20 and 20*a* and angled to recirculate the excess material 28 confined thereby or between adjacent inner edge surfaces 20*a* back into the puddle on the blanket upper surface. It is recognized that the blanket has been compressed and has some rigidity, in the vertical direction, however, the edge surfaces 20, 20*a* to be contacted by the edge coating mechanism 38 and 38*a* are somewhat less rigid and, due to their flexibility may not receive a uniform coating of the material 28, thus, rollers 42, such as a paint-type roller are disposed downstream and adjacent the edge surfaces 20 to contact the coated edge surfaces 20 tending to evenly distribute the material on such surfaces. Smaller, but similar rollers 54 (see FIG.

7) are likewise mounted to contact interior edge surfaces 20*a*.

In that the coating material 28 must also meet certain standards with respect to flame retardation, it is typical that such material is a water based material and, as such, the coated surfaces are thereafter preheated by passing through an infrared heater 44 configured to expose all coated surfaces to infra red heat, to pre-dry the upper surface and edge surfaces by vaporizing the water base. Thereafter the coated fiber glass blanket proceeds through a final curing station, such as a convection oven 46 which includes heaters for final curing of the applied coating. The fiber glass blanket 14 is thereafter rolled onto a take-up roll in standard lengths such as 100 feet for supplying to the contractor.

Figure 5:
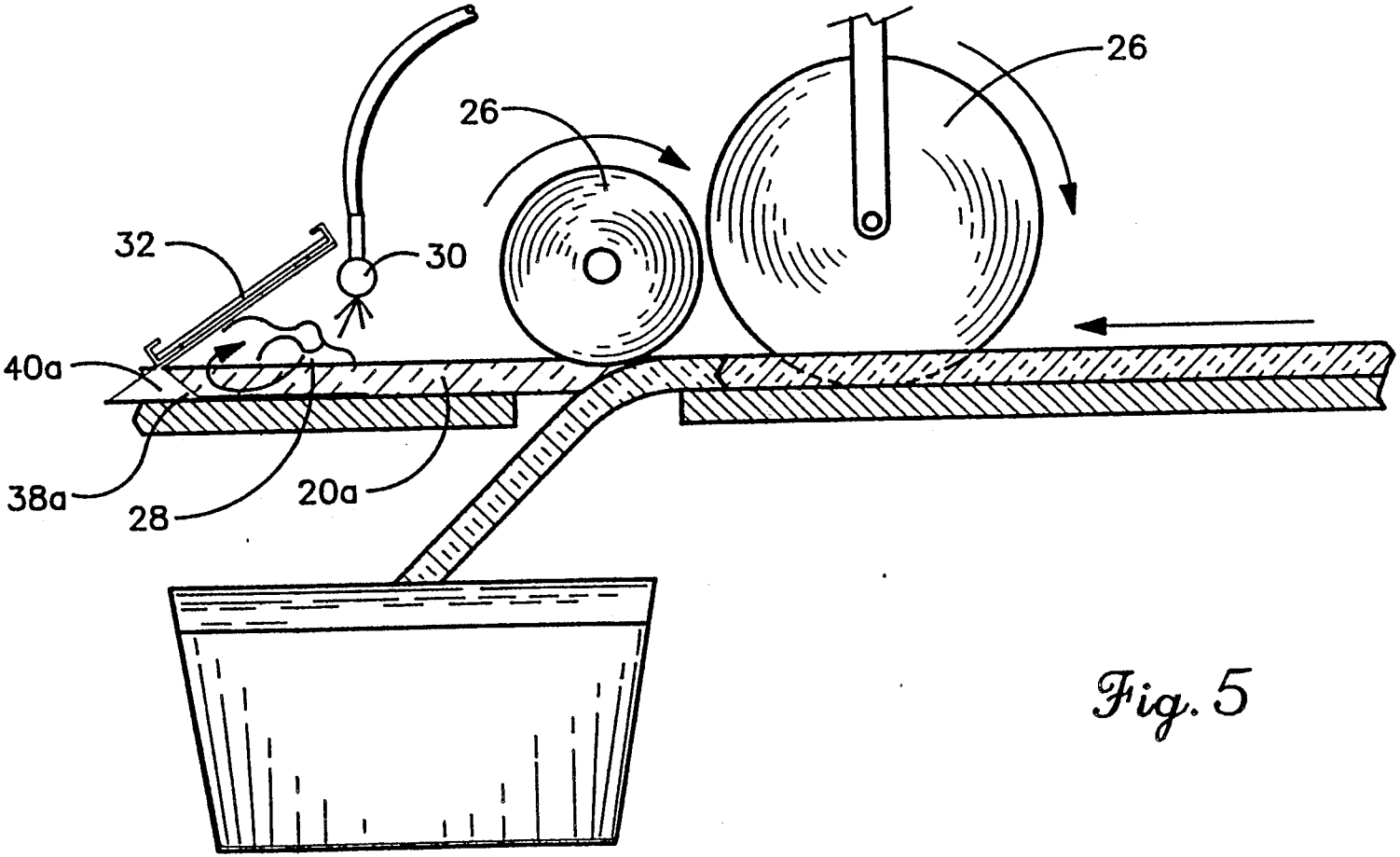
FIG. 5 is a schematic side elevational view of that portion of FIG. 4 illustrating the application blade and interior trimming discs.

Referring now to FIG. 5 it is therein shown that the central strip of fiber glass blanket that has been trimmed to divide the blanket into multiple standard widths is discarded. This can be accomplish in any preferred manner, but, as shown, the scrap strip is directed to below the blanket prior to the application of the coating material 28 to the interior edge surfaces 20*a*. Further, it is seen that the dam member apparatus 38*a* as mounted on blade 32 has an upwardly, forwardly projecting blade 40*a*, having an edge spaced closely adjacent the edge surface 20*a* of the blanket, whereby the edge spreads the coating material to the edge surface 20*a* and the upward slope redirects excess coating material back into the puddle on the upper surfaces (as illustrated by the arrow).

Figure 6:
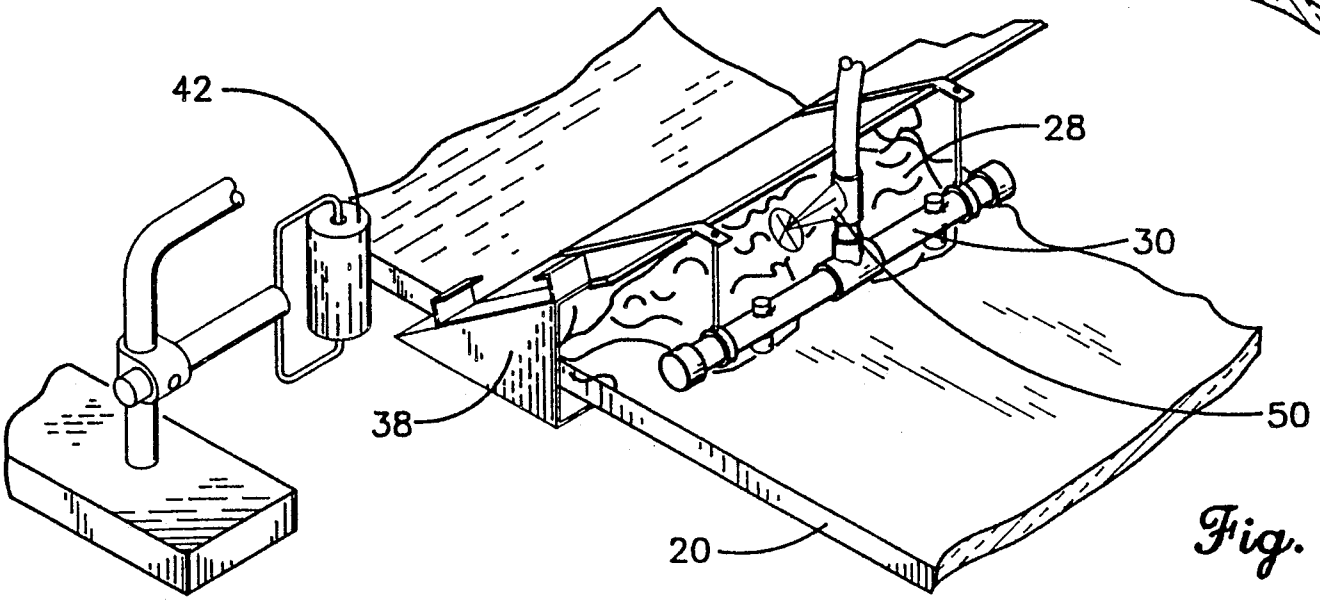
FIG. 6 is an enlarged isometric schematic view of a portion of FIG. 4 showing the coating material as applied to the main surface and an edge surface.
Figure 8:
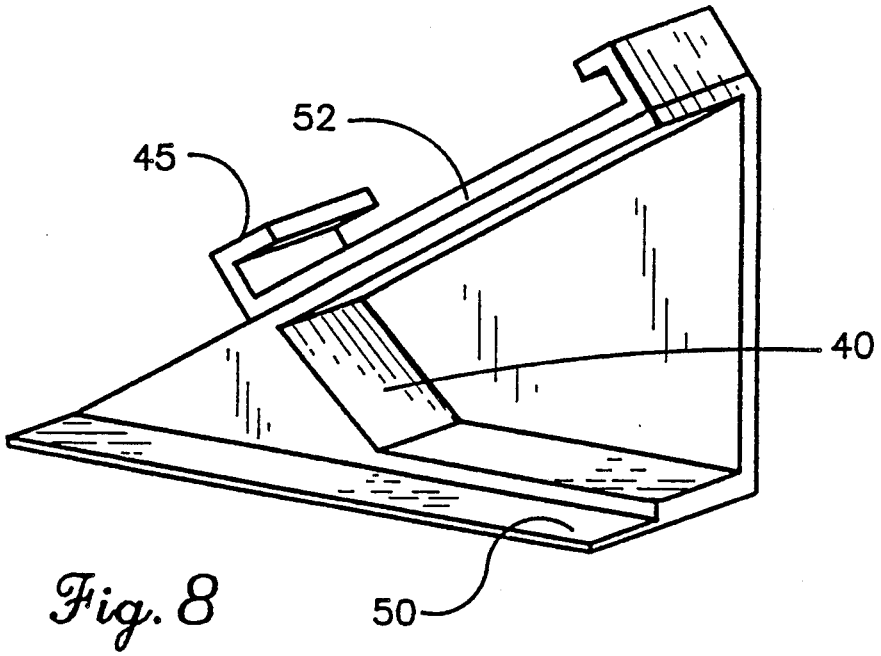
FIG. 8 is an isometric view of the edge-spreading mechanism, typical for exterior edge surfaces.
Figure 9:
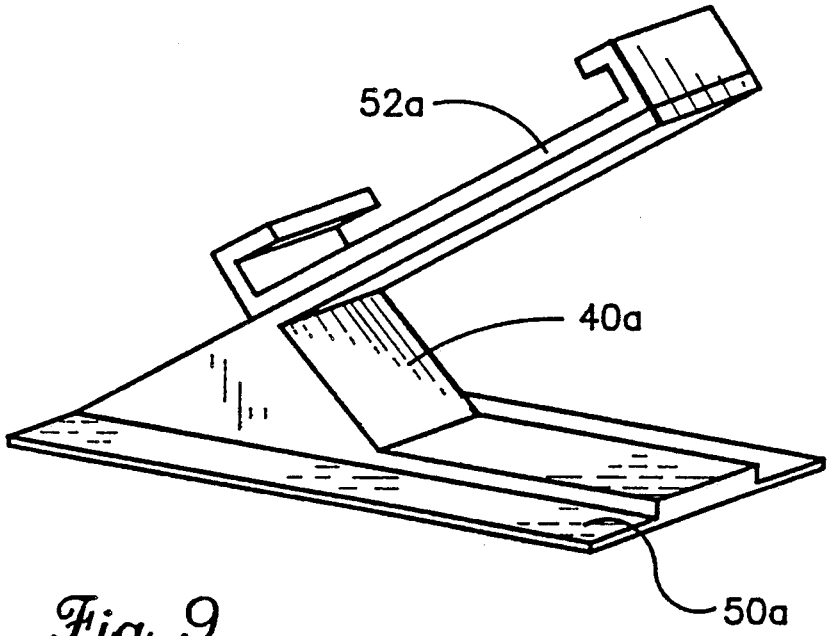
FIG. 9 is an isometric view of the edge-spreading mechanism, typical for opposed interior edge surfaces of a divided fiber glass blanket.

FIG. 6 shows an enlarged portion of the coating station of FIG. 4 and it is therein seen that the coating material 28 as supplied to the header 30 can be controlled by a valve mechanism 50 at each header 30 to thereby regulate the quantity of material 28 being supplied. Also, in conjunction with reference to FIGS. 8 and 9, the shape and configuration of the dam members 38 and 38*a* are more clearly shown. Thus, as therein seen, each dam member 38 and 38*a* has exterior tabs 45 for slidably mounting the members on the blade 32. The exterior dam member 38 has an exterior wall 39, which in conjunction with a bottom planar horizontal surface 48, and top planar diagonal surface 52 contains the coating material 25 to within the member 38 so excess material cannot escape but will be recirculated by blade 40 as previously described. Also, interior member 38*a* does not have outer wall 39 but depends on opposed edge surfaces 20*a* of the slit blanket to assist the bottom planar surface 48*a* and top diagonal surface 52*a* to contain the excess material 28 and redistribute it to the upper puddles. However, the bottom surface 48 and 48*a* are seen to extend horizontally subadjacent the blanket so the blanket rides somewhat on these surfaces, further confining the material 28 within the dam members 38 and 38*a*.

Figure 7:
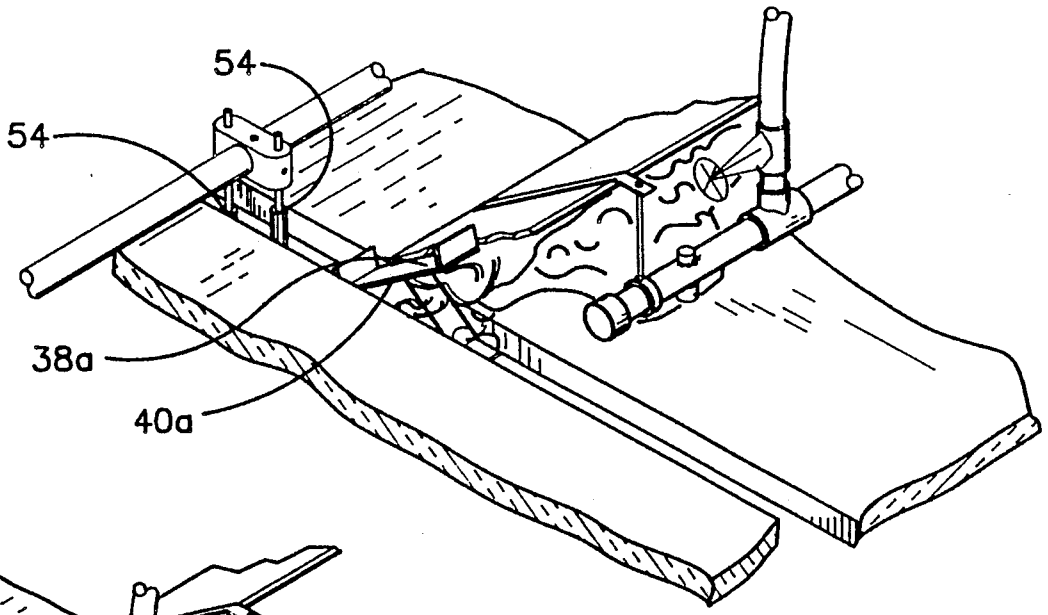
FIG. 7 is an enlarged isometric view of that portion of FIG. 4 showing the distribution and spreading of the coating material to the main surface and one interior edge surface of an internally trimmed fiber glass blanket.

FIG. 7 further illustrates the interior dam member 38*a* as disposed within the slit to simultaneously supply the overflow material 28 from each blanket to the respective interior edge surfaces 20*a*. Also shown are the interior rollers 54 adjustably mounted downstream from the dam member 38*a* for evening the application or spreading of the coating material on the interior edge surfaces. It is apparent that these rollers 54 and rollers 42 could be biased into contact with edge surfaces to accommodate any unevenness of the trimmed edge surface.

Thus, as is shown by the method and apparatus above described, the final fiber glass duct liner product 14, in addition to having the main surface coated with a material to prevent erosion, also has the exposed edge surfaces 20, 20*a* coated at the same time so that, the liner, as supplied to the contractor, does not have to be further coated by him to meet the requirements and standards for prevention of erosion of the material and eliminates from the contractor's further processing and fabrication his requirement to treat the edges of the duct liner material.

We claim:

1. An on-line process of forming a surface coated duct liner material from a fiber glass blanket comprising the steps of;

supplying a fiber glass blanket having an upper surface and opposed marginal edge surfaces;

supplying coating material to the upper surface of said blanket to cause a reservoir build-up of material on such surface;

spreading the material completely across the upper surface and causing some of the coating material to flow over the edge surfaces;

delivering said overflow material to a spreading means adjacent each edge surface and spreading the coating material across each said edge surface to coat each edge surface of the blanket; and, curing the coating on the blanket.

2. The method of claim 1 wherein each of said steps of spreading said material, namely spreading said material on said upper surface and spreading said material on said edge surfaces includes the step of recirculating excess material not spread onto said surfaces back into said reservoir build-up of material.

3. The method of claim 2 wherein said curing includes:

(1) pre-drying said coating on said surfaces in an initial heating step; and, (2) final curing by completely drying said material on all coated surfaces of said blanket.

4. The method of claim 3 wherein said spreading the material across each edge surface includes an initial application of said coating material to said edge surfaces and a subsequently doctoring the edge surfaces with a roller member to provide a generally even coating thereon.

5. Structure for the continuous on-line coating of an upper horizontal surface and opposed vertical edge surfaces of a traveling blanket of fiber glass comprising:

means for supplying a quantity of coating material to the upper surface;

means for spreading said material completely across said upper surface as said blanket travels thereby and causing at least some portion of said material to overflow down the opposed edge surfaces;

means for spreading said overflow material to said edge surfaces, said spreading means confining said overflow material and recirculating excess material for spreading on such surfaces; and means for heating said spread material after application on said surfaces to cure said material on all coated surfaces.

6. The apparatus of claim 5 wherein said means for spreading said material comprises a first blade adjacent to and extending across the upper surface of said blanket, and said means for spreading said overflow material comprises a second blade member disposed adjacent said edge surface, and further defining confining structure for retaining excess overflow material for recirculation with a reservoir of material contained therein.

7. The apparatus of claim 6 wherein said confining structure housing is moveably mounted on said first blade adjacent the end of said first blade to define, in conjunction with said first blade, means for confining the material deposited on the upper surface within the bounds of said first blade and said confining structure.

8. Structure according to claim 7 wherein said means for spreading said overflow material includes a roller disposed in rolling contact with the edge surface of said blanket downstream of said confining structure.

9. Structure according to claim 8 wherein said means for heating said material includes a pre-heater for heating the material on said upper surface and edge surfaces to pre-dry said material and a curing means for final complete drying of said material on said surfaces.

* * * * *